United States Patent [19]

Sneathen, Jr.

[11] 4,076,249

[45] Feb. 28, 1978

[54] DEVELOPMENT BOARD GAME APPARATUS

[75] Inventor: James W. Sneathen, Jr., Berlin, N.J.

[73] Assignee: The Raymond Lee Organization, Inc., New York, N.Y.

[21] Appl. No.: 677,306

[22] Filed: Apr. 15, 1976

[51] Int. Cl.[2] ..... A63F 3/00

[52] U.S. Cl. ..... 273/256

[58] Field of Search ..... 273/134

[56] References Cited

U.S. PATENT DOCUMENTS

| | | | |
|---|---|---|---|
| 2,026,082 | 12/1935 | Darrow | 273/134 AD |
| 3,362,715 | 1/1968 | Hartpence | 273/134 AC |
| 3,765,680 | 10/1973 | Paraskevas | 273/134 AC |

FOREIGN PATENT DOCUMENTS

| | | | |
|---|---|---|---|
| 611,043 | 10/1948 | United Kingdom | 273/134 AT |
| 709,543 | 5/1954 | United Kingdom | 273/134 AT |

*Primary Examiner*—Delbert B. Lowe

*Attorney, Agent, or Firm*—Howard I. Podell

[57] ABSTRACT

A game played on a board marked as a residential subdivision. Markers are moved about the board by the players in response to the play of dice, with the players representing buyers, developers and sellers of residential and commercial lots marked on the board. The board is marked with a layout of a continuous path of blocks representing a route along several joining streets, with individually numbered building lots marked adjacent each block of the route. The game includes markers for representing each player's position on a block of the route, miniature houses to represent buildings constructed by a player on a lot adjacent to his marker position, play money which may be borrowed by a player from a bank, cards representing engineering, sewer and water, paving, building, and sales and rentals contracts, together with two sets of penalty or reward cards. Individual blocks of the route are marked with colors to indicate the application of the penalty or reward cards.

1 Claim, 6 Drawing Figures

DEVELOPMENT BOARD GAME APPARATUS

SUMMARY OF THE INVENTION

My invention is a game played on a board marked as a residential subdivision.

Markers are moved about the board by the players in response to the play of dice, with the players representing buyers, developers and sellers of residential and commercial lots marked on the board.

The board is marked with a layout of a continuous path of blocks representing a route along several joining streets, with individually numbered building lots marked adjacent each block of the route.

The game includes markers for representing each player's position on a block of the route, miniature houses to represent buildings constructed by a player on a lot adjacent to his marker position, play money which may be borrowed by a player from a bank, cards representing engineering, sewer and water, paving, building, and sales and rental contracts, together with two sets of penalty or reward cards.

Individual blocks of the route are marked with colors to indicate the application of the penalty or reward cards.

My invention furnishes not only an entertaining game, but a means of educating the players in the fundamentals of real estate development.

BRIEF DESCRIPTION OF THE DRAWINGS

The objects and features of the invention may be understood with reference to the following detailed description of an illustrative embodiment of the invention, taken together with the accompanying drawings in which.

DESCRIPTION OF THE PREFERRED EMBODIMENT

Figure 1:
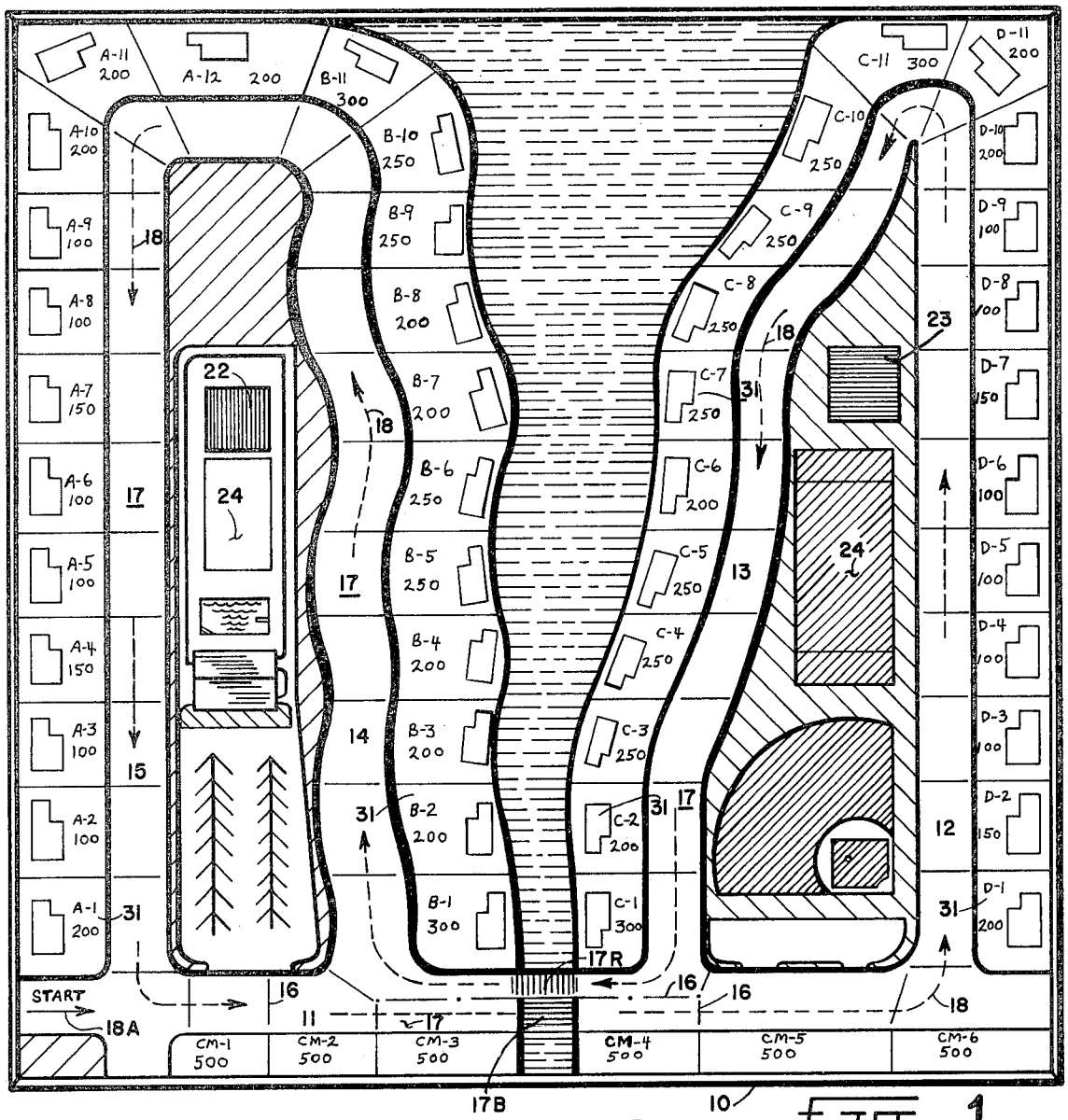
FIG. 1 is a plan view of the game board of the invention.
Figure 2:
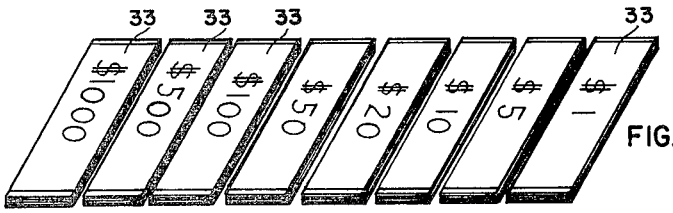
FIG. 2 is a perspective view of the play money of the bank.
Figure 3:
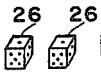
FIG. 3 is a perspective view of the dice.
Figure 4:
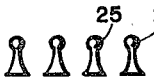
FIG. 4 is an elevation view of the playing markers.
Figure 5:
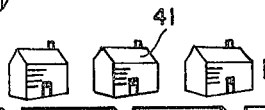
FIG. 5 is a perspective view of the play houses.
Figure 6:
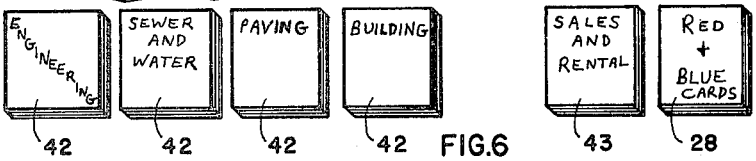
FIG. 6 is a perspective view of the play cards.

Turning now descriptively to the drawings, in which similar reference characters denote similar elements throughout the several views, FIG. 1 illustrates the game board 10 which is laid out in the form of a route along several inter-connected streets 11–15, with each street marked with dividing lines 16 to form blocks 17 of a route marked by arrows 18. Each block 17 of a street is bounded by a marked lot 31 with an index number such as A-1, B-1, C-1, D-1 and a numeral such as 500, 200, 300 indicating an amount of money. One or more blocks 17B of the route are marked in blue and one or more blocks 17R are marked in red.

Individual areas 22 and 23 are marked to indicate the placement of red and blue reward and penalty cards 28 prior to their use, with other areas 24 marked to indicate the placement of such cards 28 when displayed.

Each player utilizes a marker 25 which is initially placed at the position indicated by start arrow 18A and subsequently moved by the player a number of blocks 17 along the route indicated by the play of a pair of dice 26. If the player's marker lands on a block 17B or 17R, he draws a blue or red reward or penalty card 28 from a pile and follows the instructions marked on the card.

A player whose marker lands on a block 17 adjacent a marked lot is entitled to purchase the lot for a sum of play money represented by cards 33.

Players may also buy markers 41 shaped as houses for placement on lots which they have acquired using play money 33 acquired by mortgage loans from a bank, and they may buy contracts represented by cards 42 for engineering services or for contracting services. The players also exchange play money for sales and rental contracts represented by cards 43.

Since obvious changes may be made in the specific embodiment of the invention described herein, such modifications being within the spirit and scope of the invention claimed, it is indicated that all matter contained herein is intended as illustrative and not as limiting in scope.

Having thus described the invention, what I claim as new and desire to secure by Letters Patent of the United States is:

1. A game apparatus for use in a game that is played on a marked board to simulate the development of a real estate subdivision, and the various stages of construction of individual buildings on lots in a said real estate subdivision, comprising a game board, said game board marked in the form of a route laid along connecting streets, with the route marked with dividing lines to form individual blocks, with each said block bounded on one side by a marked lot indentified by an index insignia and by a purchase price, with at least two blocks, each marked with contrasting indicia that distinguish them from each other and from the remainder of the said blocks, said route marked along its length with arrows indicating the direction of travel of individual markers on the blocks of said route, together with a plurality of individual first markers for use in locating the position of individual players in individual blocks of said route, a plurality of individual second markers for use by the players in placing on individual lots, said second markers distinguishable in appearance from said first markers, play money for purchasing individual contracting services required in the construction of a building on a said lot, play cards marked to represent individual constracting services required in the construction of a building on a said lot, a set of reward cards and a set of penalty cards to be used by players whose markers have landed on any block marked with one of said contrasting indicia, and random number generating means for use by the players in moving their markers on the said route of blocks.

* * * * *